US007559426B2

(12) United States Patent
Habatjou

(10) Patent No.: US 7,559,426 B2
(45) Date of Patent: Jul. 14, 2009

(54) PACKAGING AND/OR APPLICATOR DEVICE FOR APPLYING AT LEAST ONE SUBSTANCE

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 577 days.

(21) Appl. No.: 11/248,565

(22) Filed: Oct. 13, 2005

(65) Prior Publication Data

US 2006/0075964 A1 Apr. 13, 2006

Related U.S. Application Data

(60) Provisional application No. 60/621,068, filed on Oct. 25, 2004.

(30) Foreign Application Priority Data

Oct. 13, 2004 (FR) ..... 04 10822

(51) Int. Cl.
*B65D 69/00* (2006.01)

(52) U.S. Cl. ..... 206/581; 206/229; 132/317; 132/318

(58) Field of Classification Search ..... 206/581, 206/1.9, 484, 229, 232; 132/317, 318, 312; 118/506
See application file for complete search history.

(56) References Cited

U.S. PATENT DOCUMENTS

| | | | | |
|---|---|---|---|---|
| 2,042,584 | A | 6/1936 | Bustamante | |
| 2,561,400 | A | 7/1951 | Morrell | |
| 2,717,174 | A * | 9/1955 | Casanovas | 239/56 |
| 4,838,851 | A * | 6/1989 | Shabo | 604/1 |
| 4,883,079 | A * | 11/1989 | Sakamaki et al. | 132/318 |
| 4,890,872 | A * | 1/1990 | Parrotta et al. | 283/56 |
| 5,037,139 | A * | 8/1991 | Schoenleber et al. | 283/56 |
| 5,072,831 | A * | 12/1991 | Parrotta et al. | 206/232 |
| 5,301,697 | A * | 4/1994 | Gueret | 132/298 |
| 5,348,031 | A * | 9/1994 | Cloud | 132/317 |
| 5,799,675 | A | 9/1998 | Gunderman et al. | |
| 5,879,769 | A * | 3/1999 | Greenland et al. | 428/35.7 |
| 5,980,960 | A * | 11/1999 | Amitai | 426/115 |
| 6,119,704 | A | 9/2000 | Bouchat et al. | |
| 6,691,872 | B1 * | 2/2004 | Berman et al. | 206/484 |
| 2003/0213724 | A1 | 11/2003 | Dobler | |
| 2004/0139703 | A1 * | 7/2004 | Abergel | 53/467 |
| 2004/0139979 | A1 | 7/2004 | Abergel | |
| 2005/0252824 | A1 * | 11/2005 | Christian | 206/581 |

FOREIGN PATENT DOCUMENTS

| | | |
|---|---|---|
| EP | 1 415 570 A1 | 5/2004 |
| WO | WO 91/17931 | 11/1991 |
| WO | WO 99/23908 | 5/1999 |

* cited by examiner

*Primary Examiner*—David T Fidei
(74) *Attorney, Agent, or Firm*—Oliff & Berridge, PLC

(57) ABSTRACT

A packaging and applicator device for applying at least one substance may include: a support that includes at least one cavity configured to containing the substance; and an applicator that includes at least one cut out part of the support that is secured to the support at least before use.

32 Claims, 5 Drawing Sheets

Fig.3
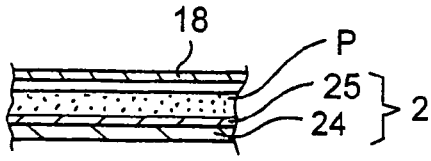
Fig.4
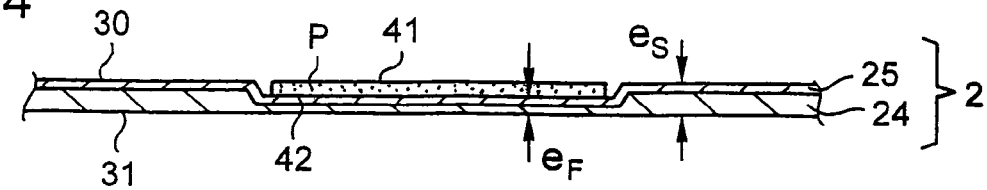
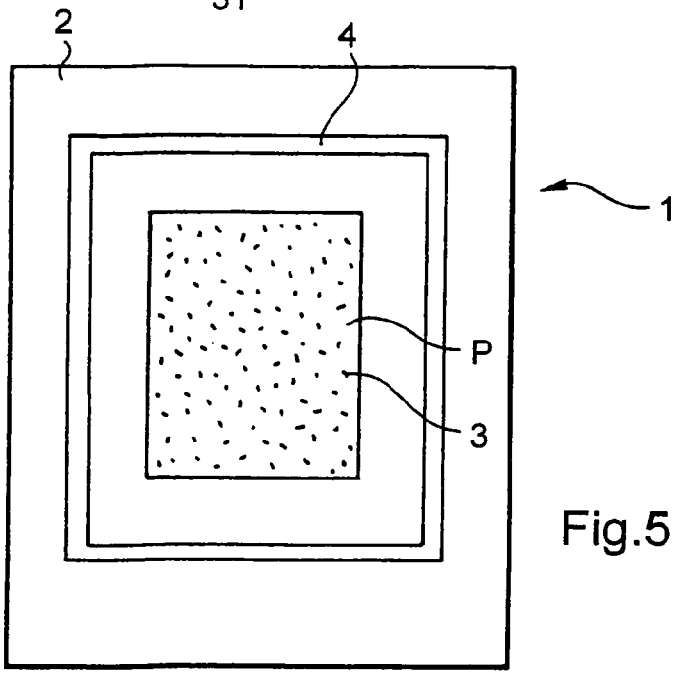
Fig.5
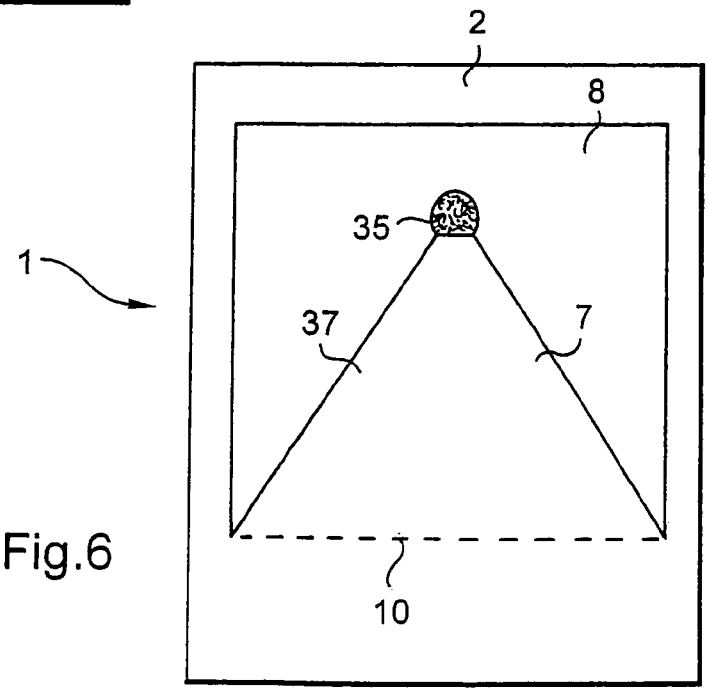
Fig.6

PACKAGING AND/OR APPLICATOR DEVICE FOR APPLYING AT LEAST ONE SUBSTANCE

CROSS-REFERENCE TO RELATED APPLICATIONS

This non-provisional application claims the benefit of French Application No. 04 10822 filed on Oct. 13, 2004, and U.S. Provisional Application No. 60/621,068 filed on Oct. 25, 2004, the entire disclosures of which are incorporated herein by reference.

The present invention relates to packaging and/or applicator devices for applying at least one substance, for example, a cosmetic, such as a cosmetic sample.

BACKGROUND

Cosmetic samples are sometimes packaged in flexible pouches comprising heat-sealed films that may be stuck to advertising inserts inside magazines. Such packaging is not very satisfactory for substances that need to be applied by an applicator, or for substances that are usually associated with luxury packaging.

Dishes made out of a thermoformed material are also known for containing a cosmetic sample, with such dishes generally being closed by a heat-sealed film.

U.S. Pat. No. 5,799,675 teaches packaging a sample in a cavity formed by embossing a sheet of thermoformable plastics material or a sheet of paper laminated with a barrier-forming material.

U.S. Pat. No. 2,561,400 describes a plurality of substance-filled cavities that are formed by thermoforming a polymer or by molding cardboard. The cavities are covered by a plurality of superposed films that are held together by a fastener.

U.S. Pat. No. 6,119,704 discloses a support for a plurality of applicators, said applicators being formed in the support and being suitable for being detached from said support by perforations defining an outline thereof.

Finally, U.S. Pat. No. 2,042,584 describes a matchbook-type package comprising a plurality of applicators impregnated with lipstick, each applicator being detachable from the package by perforations provided at a base thereof.

SUMMARY

Thicknesses of known dishes make their insertion in magazines difficult. Known packaging may not have an applicator supplied, as in the 675 Patent. Such a device as taught by the 400 Patent is not intended to be inserted between the pages of a magazine. The applicators of the 704 Patent are intended to be used with a cosmetic sample that is independent of the support, thereby requiring additional packaging to be provided for the cosmetic sample, and consequently complicating insertion in a magazine, for example. Such packaging as taught by the 584 Patent can turn out to be unsuitable for a substance in powder form, for example.

There exists a need to benefit from a packaging and/or applicator device for applying at least one substance, that is easy to make, and of a cost that is compatible with the packaging and/or applicator being distributed for advertising purposes, for example.

Various aspects of the present invention may satisfy that need.

Exemplary embodiments of the invention may provide a packaging and applicator device for applying at least one substance, for example, a cosmetic, the device comprising a support comprising: at least one cavity for containing the substance; and an applicator including at least one portion that is made by cutting out part of the support, and that is secured to said support at least before use.

In exemplary embodiments, the cavity may be unique. Additionally or alternatively, the applicator may be unique.

In exemplary embodiments, the support may be made out of a fibrous material. The cavity may be made at least partially, for example, entirely, of a fibrous material.

In exemplary embodiments, at least part of the applicator may be made integrally as a single piece with the support. Such embodiments may thereby provide low cost, and may thereby facilitate insertion in a magazine, where appropriate or desired.

Furthermore, when at least part of the applicator is made by cutting out the support, e.g., when at least part of the applicator comprises a cut out part of the support, the applicator may be made substantially in a thickness of the support. The support may thus protect the applicator to some degree from stresses that are likely to be exerted on the device when said device is inserted in a magazine, for example.

In exemplary embodiments, the support may be made out of a fibrous material, for example, cardboard. Such a support may enable an appearance of the cosmetic sample to be compatible with an image conveyed by certain brands, for example.

In exemplary embodiments, the cavity may be made by deforming the support, for example, mechanically and/or thermally. Thus, the cavity may comprise a mechanical and/or thermal deformation of the support.

For example, the cavity may be made by embossing the support, for example, when said support is made out of cardboard. The term "embossing" should be understood broadly and encompasses stamping. Thus, the cavity may comprise an embossing of the support.

In exemplary embodiments, the cavity may be made while the support is being manufactured, for example, by watermarking when the support is made out of cardboard, and when the support is thick enough. In exemplary embodiments, the cavity may include a bottom wall of a thickness that is less than or equal to a thickness of at least a portion of the support situated around the cavity.

In exemplary embodiments in which the cavity is made by embossing, said cavity may project on a face of the support that is remote from a face of the support into which the cavity opens, which is the face that receives the substance. The cavity may project over a height that may be less than or equal to a nominal thickness of the support, for example.

In exemplary embodiments, the support may include at least one layer of a barrier-forming material extending at least into the cavity. The at least one layer of barrier-forming material may isolate the cardboard from the substance, for example, and/or may improve conservation of said substance by limiting evaporation of volatile solvents, for example. The barrier-forming material may, for example, be selected from the following: polyolefins, in particular high-density polyethylene (HDPE); metals, in particular aluminum; varnishes; and laminates made with such materials, this list not being limiting. The barrier-forming material may be deposited by being coated or rolled onto a remainder of the support.

In exemplary embodiments, the barrier-forming material may optionally cover at least one face of the support completely.

In exemplary embodiments, the cavity may be filled at least in part by the substance. The substance may comprise a cosmetic, for example. The term "cosmetic" as used in the context of the present invention means a "cosmetic product" as defined in the Jun. 14, 1993 EEC Directive 93/35 modifying EEC Directive 76/768. The substance may be a solid, a paste, or a liquid. The substance may also be a powder. For example, the substance may be intended for making up the lips, the skin, hair, or the nails. The substance may possibly impregnate at least part of a porous substrate that is disposed, at least in part, in the cavity. Such a porous substrate may include, for example, a woven fabric, a non-woven fabric, a foam, a net, a felt, or flocking. Where appropriate or desired, the substance may be covered by a mesh or a permeable film.

In exemplary embodiments, the device may include a peel-off film closing the cavity in a sealed manner before first use. For example, the film may be stuck or bonded onto a region of the support bordering the cavity. Where appropriate or desired, the barrier-forming material may be used to hold the cavity-forming film in place. The peel-off film may be a flexible film comprising a thermoplastic material.

On one or more faces, the applicator may include a substance-application surface that may be defined, at least in part, by a material that is different from a material or materials of the support. For example, the application surface may comprise a flocking, a foam, or a felt, whereas the portion of the support forming a remainder of the applicator may include or may be constituted by cardboard, for example.

In exemplary embodiments, the applicator may be connected to the remainder of the support via a zone of weakness which may include perforations that may facilitate detachment of the applicator from the remainder of the support.

In exemplary embodiments, the applicator may include a score line that enables the applicator to be folded in half.

In exemplary embodiments, at least part of the applicator may extend into a window of the support. This may facilitate, for example, handling of the applicator and detaching of the applicator from the support. Where appropriate or desired, this may also facilitate making the application surface out of a material that is different from the material or materials of the support.

In exemplary embodiments, the support may include at least one bead that is distinct from the cavity. The bead may be made by deforming the support, for example, by mechanically deforming the support, for example, by embossing the support. The bead may possibly be obtained by thermally deforming the support, when the nature of said support allows for thermal deformation. The bead may be delimited by two external surfaces, located on a same side of the support.

In exemplary embodiments, the cavity may preferably opens into a first face of the support, and the bead may project on a second face of the support, remote from the first face. Such a configuration may make it possible to limit the risk of flattening the cavity in the event of the support being compressed.

In exemplary embodiments, the bead may also serve to protect the applicator, for example, when a face of said support includes a material that is designed to form the application surface. In such case, the bead may project on the face of the support that is remote from the face covered in the material.

In exemplary embodiments, the bead may extend around the cavity and/or the applicator in a continuous or discontinuous manner. The bead may include a shape that matches an outline of the cavity or an outline of the window of the support in which the applicator extends.

In exemplary embodiments, the bead may include a thickness that is not less than a depth of the cavity. A thickness of the applicator at the application surface may be less than or equal to the thickness of the bead.

In exemplary embodiments, the device may include at least one hinge that enables the support to be folded in half. For example, the hinge may be disposed substantially in a middle of the support, separating two portions that have substantially equal dimensions and that become substantially superposed after folding. The hinge may be formed by at least one groove formed in the support.

In exemplary embodiments, the support may include a detachable flap arranged to facilitate fastening the device to an article, for example, to packaging or to a page of a magazine. The detachable flap may enable a useful portion of the support to be detached without damaging the article.

Exemplary embodiments of the invention may provide a method of manufacturing a device as defined above, the method comprising: embossing the support so as to form the cavity; and cutting out part of the support so as to form the applicator.

In exemplary embodiments, the method may further comprise depositing the substance in the cavity, for example, by a printing technique or by pouring the substance into the cavity, for example, by casting the substance while hot.

In exemplary embodiments, the method may also comprise embossing the support so as to form the bead. The cavity and the bead may be made simultaneously or in succession.

Exemplary embodiments of the invention, independently or in combination with the above, may provide a packaging device for packaging a substance, for example, a cosmetic, the device comprising a support comprising: a cavity made by deforming the support, said cavity opening to a first face of the support, and being designed to contain the substance; and a bead that is distinct from the cavity and that is situated set back from a periphery of the support, said bead not being designed to contain substance, and being made by deforming the support, opening on a same face of the support as the cavity and projecting on a second face of the support, remote from the first face. In such embodiments, the bead may project at least substantially as much as the cavity.

In exemplary embodiments, the support may be made of a fibrous material. The bead may extend continuously or discontinuously around the cavity at a distance therefrom.

In exemplary embodiments, the support may optionally include an applicator that is made by cutting out part of the support, or that is made in some other way.

In exemplary embodiments, the bead may be continuous. The support may be designed to be fastened to an article, such as a magazine page or packaging, or may be designed to form part of the packaging.

Exemplary embodiments of the invention may provide an applicator device for applying a substance, for example, a cosmetic, the device comprising a support including at least one applicator, said applicator including at least one portion that is made by cutting out part of the support, with at least part of said portion extending into a window of the support.

In such exemplary embodiments, the support may optionally include a bead that serves to protect the applicator.

In exemplary embodiments in which such a bead is envisaged, said bead may, for example, be made by embossing the support, and said bead may extend around the window.

Still in exemplary embodiments, the support may include a cavity containing the substance to be applied. Where appropriate or desired, the applicator carries the substance to be applied.

In exemplary embodiments, the support may be designed to be fastened to an article or to form part of packaging.

BRIEF DESCRIPTION OF THE DRAWINGS

Various details and aspects of the invention will be better understood on reading the following detailed description of non-limiting embodiments thereof, and on examining the accompanying drawings, in which:

FIG. 3 shows a detail III of FIG. 2;

FIG. 4 is a view similar to FIG. 2, showing another exemplary embodiment;

FIGS. 5 to 7 are diagrammatic views similar to FIG. 1, showing other exemplary embodiments;

DETAILED DESCRIPTION OF EMBODIMENTS

Figure 1:
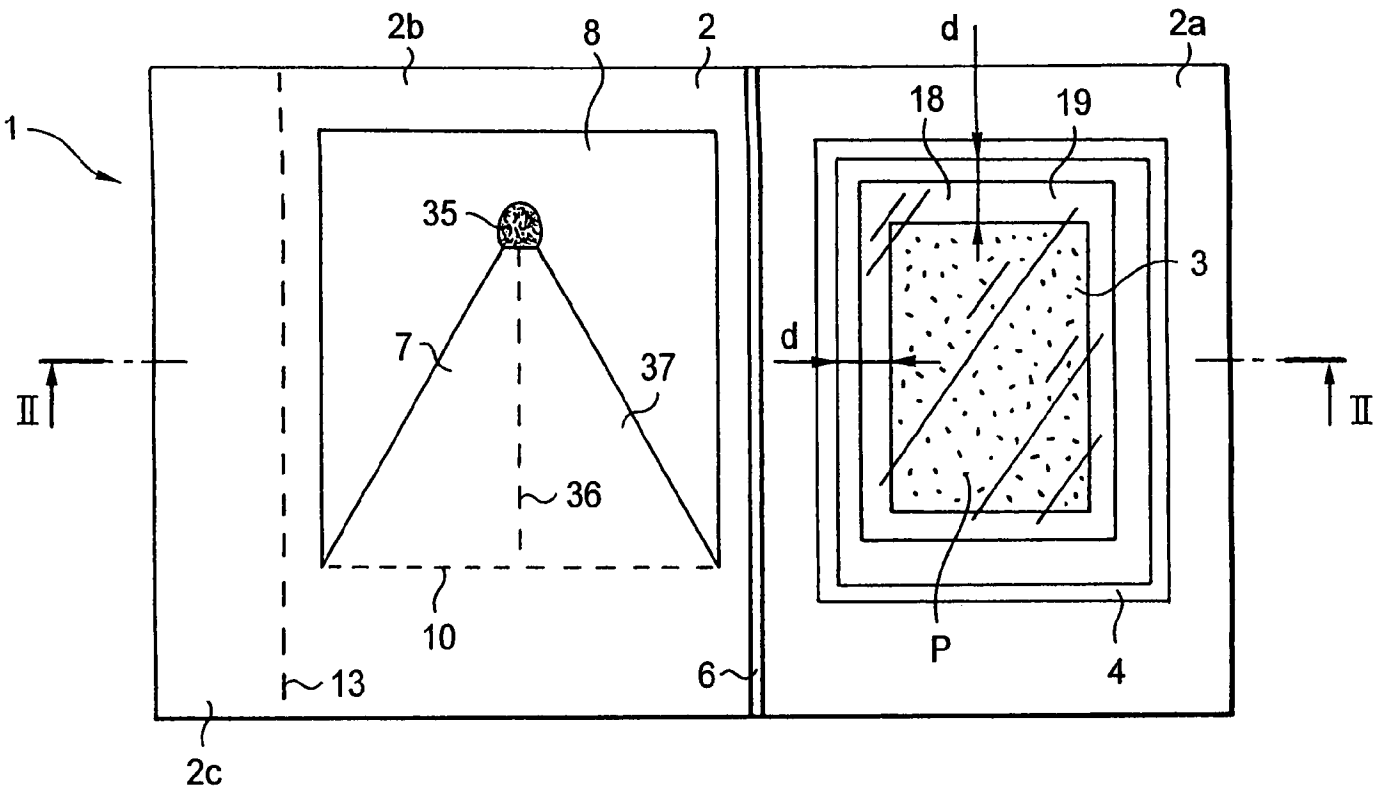
FIG. 1 is a diagrammatic plan view of an exemplary a device.

In the drawings, the relative proportions of the various component elements are not always maintained for the purpose of clarity.

Figure 2:
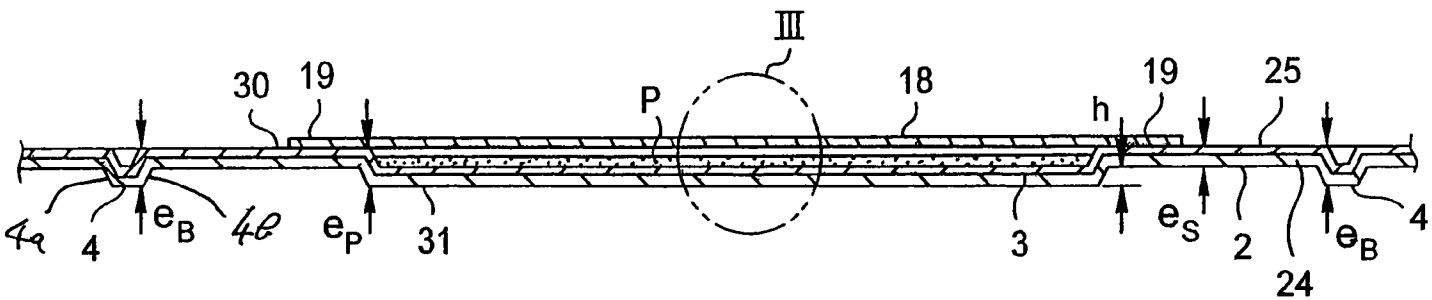
FIG. 2 is a diagrammatic and fragmentary cross-sectional view taken along II-II of FIG. 1.

FIGS. 1 to 3 show an exemplary packaging and applicator device 1 comprising a support 2. The support 2 includes a cavity 3 that opens into a first face 30 of the support 2, and that is filled with a substance P, for example, a cosmetic composition.

The cavity 3 is surrounded by a bead 4. The cavity 3 is situated with the bead 4 in a first portion 2*a* of the support 2. The first portion 2*a* may be separated from a second portion 2*b* of the support 2 by a hinge 6 formed by a groove opening to the first face of the support 2.

As shown, the bead 4 extends at a distance from the cavity 3 and is delimited by two surfaces 4*a* and 4*b* that are located on a same side of the support.

The portions 2*a* and 2*b* are substantially equal in size so that the portions 2*a* and 2*b* may become substantially superposed when the support 2 is folded about the hinge 6.

In the second portion 2*b*, an applicator 7 extends into a window 8 of the support 2. The applicator 7 is connected to the support 2 solely via a zone of weakness 10.

The support 2 also includes a detachable flap 2*c* that is separated from the second portion 2*b* by a zone of weakness 13. The flap 2*c* serves to fasten the device 1 to an article, such as packaging or a page of a magazine, for example, and may facilitate detachment of a remainder of the support 2 from the flap 2*c* by a user.

The device 1 may be made with rounded corners, for example, so as to prevent them from being distorted or torn.

For example, the dimensions of the support 2 may lie in a range of 1 centimeter (cm) to 25 cm for each side, or even better in a range of 10 cm to 20 cm. The support may be rectangular in shape, with a long side thereof being perpendicular to the hinge 6, in embodiments that include such a hinge.

In the exemplary embodiment shown, the cavity 3 is closed by a film 18 that is secured by adhesive or heat sealing in a region 19 of the support 2 adjacent to the cavity 3. The film 18 is preferably arranged to close the cavity 3 in a sealed manner. For example, the film 18 is a composite comprising a polyethylene film covered by a layer of aluminum.

In the exemplary embodiment shown, the support 2 comprises a sheet 24 made of a fibrous material, such as cardboard. Where appropriate or desired, the support 2 may be made entirely of one or more non-fibrous materials, for example, a thermoformable polymer, without going beyond the ambit of the present invention.

The cardboard may advantageously be long-fibered with little recycling, for example, so as to prevent the support 2 from tearing.

In the exemplary embodiment shown, the sheet 24 of the support 2 is coated, covered in film, laminated, or covered in one or more layers 25 of one or more barrier-forming materials, for example, a material that is impermeable to solvents and/or to oils contained in the substance.

Examples of barrier-forming materials include polyolefins, such as high-density polyethylene (HDPE); metals, such as aluminum; or even varnishes.

In the exemplary embodiment shown, the barrier-forming layer 25 completely covers the first face 30 of the support. However, this is not essential, and in other exemplary embodiments, the layer 25 may extend only in the cavity 3 and in the adjacent region 19.

To make the cavity 3, the support 2 may be embossed, for example.

In the exemplary embodiment shown, the cavity 3 is formed in the first face 30 of the support and projects on the opposite face 31 of the support 2 over a height h that is less than or equal to a nominal thickness $e_s$ of the support 2.

It is contemplated that the cavity 3 may be made in some other way, for example, by flattening part of the support 2 when the support 2 is sufficiently thick, or by watermarking the sheet 24. For the cavity not to project on the face 31 of the support 2, as shown in FIG. 4, the bottom wall 42 of the cavity may include a thickness $e_f$ that is less than the nominal thickness $e_s$ of the support 2 in the vicinity of the cavity 3 and outside the cavity.

For example, the bead 4 may be made simultaneously with the cavity 3 by embossing the support 2.

In the exemplary embodiment shown, the bead 4 presents a thickness $e_b$ and the cavity presents a thickness $e_p$ that is less than or equal to the thickness $e_b$. Thus, when the device 1 becomes compressed, for example, because the device 1 is inserted between the pages of a magazine transported in a stack, the cavity 3 is flattened to a lesser extent than it would have been flattened if there were no bead 4.

Around the cavity 3, a distance d between the bead 4 and the cavity 3 may preferably be sufficient to enable the bead 4 to be formed by embossing, without deforming the cavity 3.

The substance P may take any form, and may be a solid, a liquid, a paste, or a powder, for example. The substance P may be cast into the cavity 3 while hot, or may be deposited therein using a printing technique. Alternatively, as shown in FIG. 4, the substance P may impregnate a substrate 41, which may be a woven fabric, a non-woven fabric, a felt, or a foam. The substrate 41 may be secured in the cavity 3 using any means, for example, by adhesive.

The applicator 7, made in the support 2, may include a substantially triangular body 37, with one end that is connected to the support 2 via the zone of weakness 10. The body 37 may be terminated at an opposite end thereof by an endpiece, for example, with a rounded shape, that defines, on one face, at least one application surface 35 for coming into contact with a region of the body or the face to be treated once substance P has been removed from the cavity 3.

In the exemplary embodiment shown, the application surface 35 is defined by a coating, for example, a flocking, a foam, or a felt, deposited on the material(s) of the support 2.

As in the exemplary embodiment shown, the applicator 7 may include a central score line 36 made by perforating the body 37, for example, which may enable the applicator 7 to be folded in half, if necessary or desired, once the applicator 7 has been detached from the support 2, for example, to stiffen the applicator 7.

The applicator 7 may not be in contact with the substance before first use.

The zones of weakness 10 and 13 and/or the score line 36 may be obtained via needles, blades, water jets, laser, or in some other way.

To make the device 1, it is possible to take a sheet of cardboard, which has been coated or laminated, where appropriate or desired, with one or more barrier-forming materials, and to cut the support 2 out of the sheet in the desired format.

The cavity 3, the bead 4, and the hinge 6 may be made by mechanically deforming the support 2, for example, by passing the support 2 through a press or between rollers carrying suitable portions in relief.

The applicator 7 may be formed by cutting out the window 8, for example, in a rectangular shape as shown.

The various cuts and/or score lines may be made before or after the cavity 3 and the applicator 7 have been formed. The applicator coating defining the application surface 35 may be deposited before or after the applicator 7 has been cut out.

For example, the substance P may be cast into the cavity 3 while hot, or may be deposited in some other way, for example, by a printing technique, or by being compacted. Then the film 18 may be secured to the support 2 so as to close the cavity 3 in a sealed manner.

As shown in FIG. 5, it is contemplated that the support 2 may include only the cavity 3 filled with substance P together with the bead 4 protecting the cavity 3 from being accidentally squashed, as described above.

In another exemplary embodiment not shown, the bead 4 of the exemplary embodiment of FIG. 1 may be replaced by a plurality of discontinuous segments or studs of the same thickness $e_b$.

In the exemplary embodiment of FIG. 6, the device 1 may include only the applicator 7, which is made without the score line 36.

For example, the application surface 35 may be defined by a foam stuck to the support 2. Where appropriate or desired, the application surface 35 may be defined by the substance to be applied.

Figure 7:
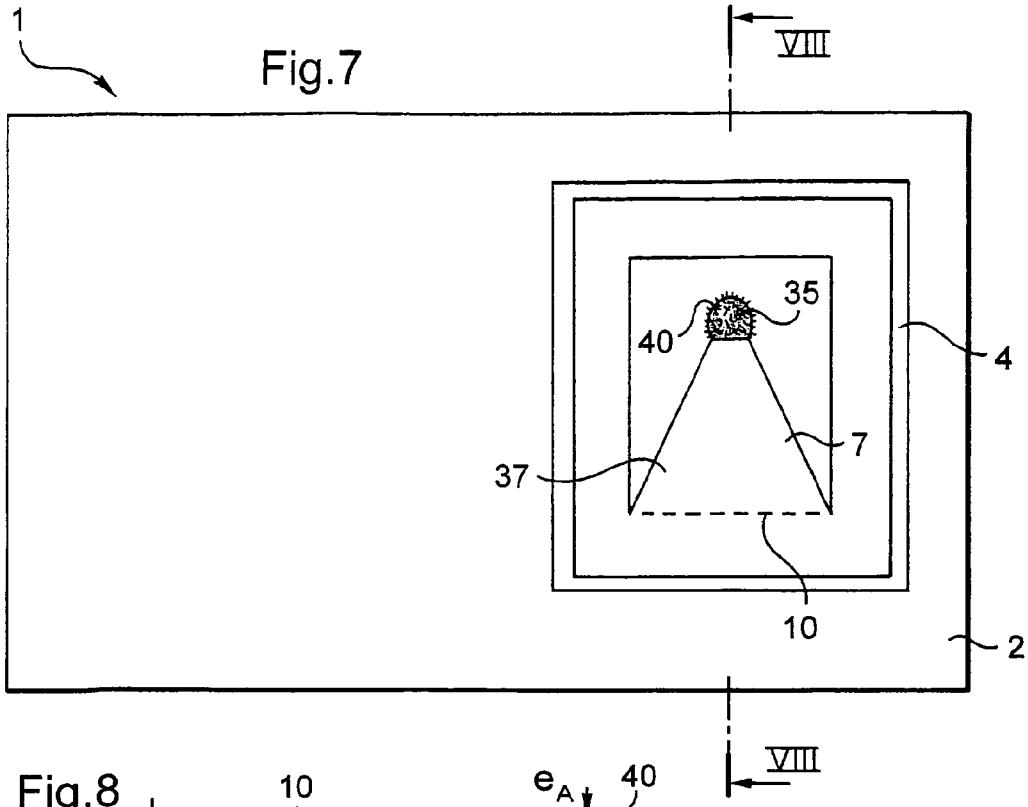

As shown in FIG. 7, the applicator 7 may advantageously be surrounded by the protective bead 4. In FIG. 7, the application surface 35 is defined by a flocking 40.

Figure 8:
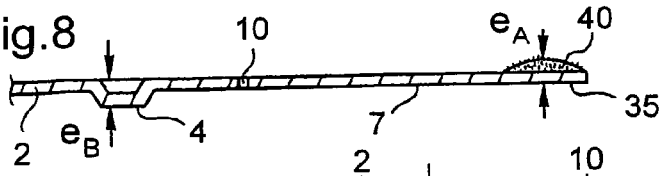
FIG. 8 is a diagrammatic and fragmentary cross-sectional view taken along VIII-VIII of FIG. 7.
Figure 9:
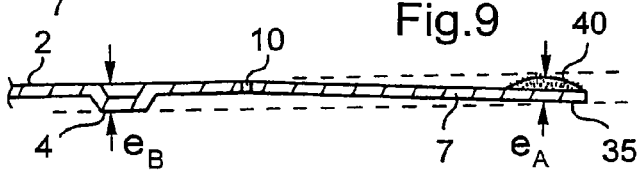
FIG. 9 is a view similar to FIG. 8, after the applicator has pivoted a little.

In FIGS. 8 and 9, the thickness $e_b$ of the bead 4 may be greater than the total thickness $e_a$ of the applicator 7 at the application surface 35. Thus, in the event of the support 2 being compressed, the applicator 7 may pivot a little about the frangible zone 10, as shown in FIG. 9, and the application surface 35 is flattened little, if at all, because of the presence of the bead 4.

Figure 10:
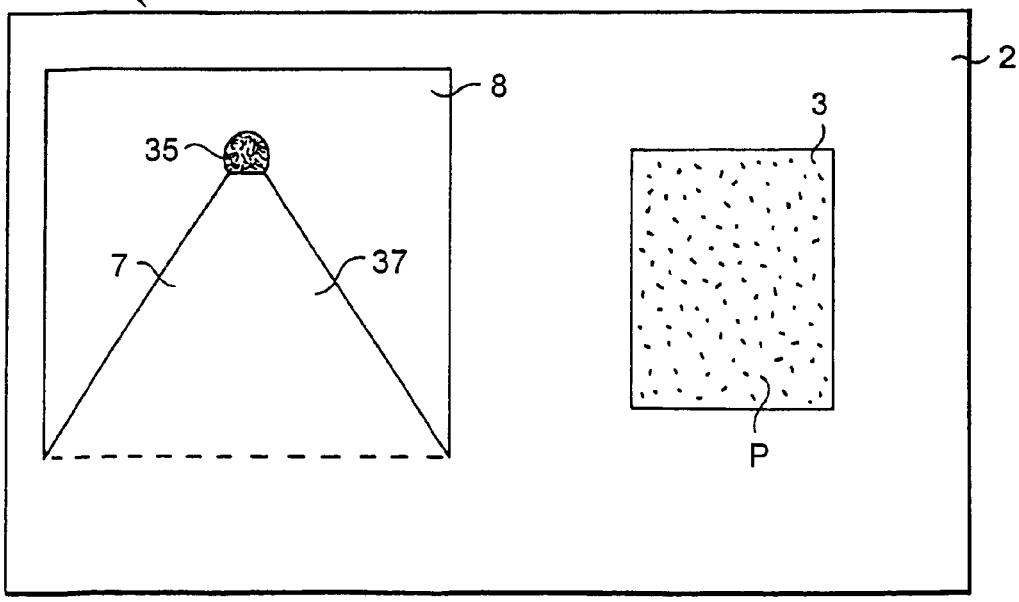
FIGS. 10 to 12 are diagrammatic views similar to FIG. 1, showing other exemplary embodiments.

It is contemplated that the bead 4, the hinge 6, and the flap 2*c* of the support 2 in the exemplary embodiment of FIG. 1 to be omitted, as shown in FIG. 10.

Figure 11:
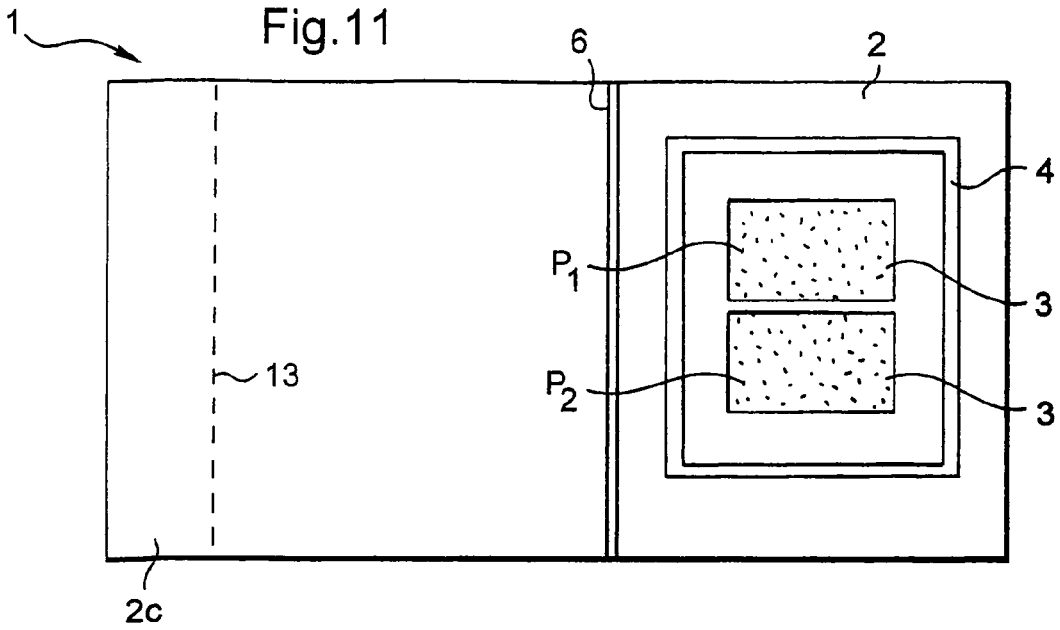

As shown in FIG. 11, it is also contemplated that the support 2 may include a plurality of cavities 3 for containing various substances, for example.

For example, the support 2 may include two cavities 3, one being filled with a substance $P_1$ and the other being filled with a substance $P_2$. In the exemplary embodiment shown, the bead 4 surrounds both of the cavities 3, but two beads 4 may be envisaged, each surrounding an associated cavity 3.

Figure 12:
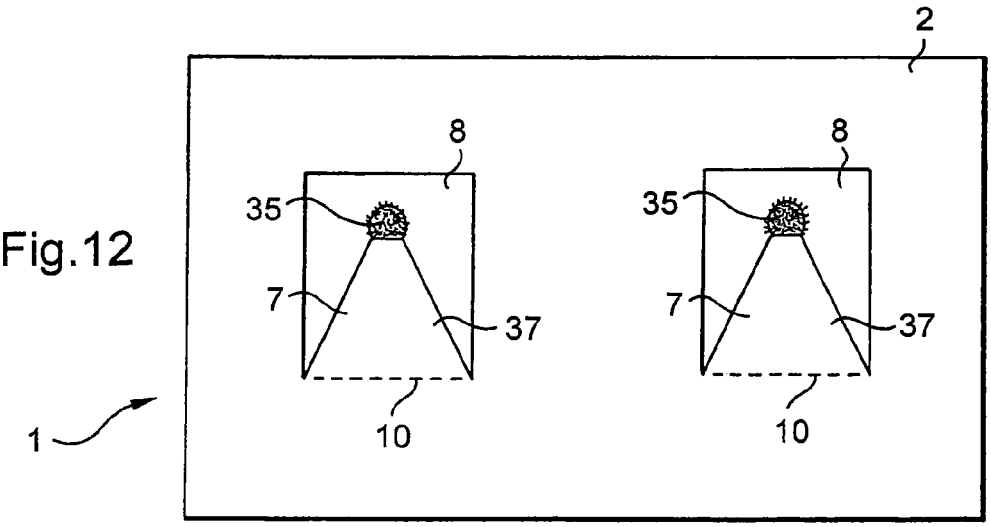

As shown in FIG. 12, the device may comprise a plurality of applicators 7, each extending into a respective window 8 of the support 2.

Where appropriate or desired, the application surface 35 may be defined by a substrate that is impregnated with a substance, or may be constituted by the substance itself.

Figure 13:
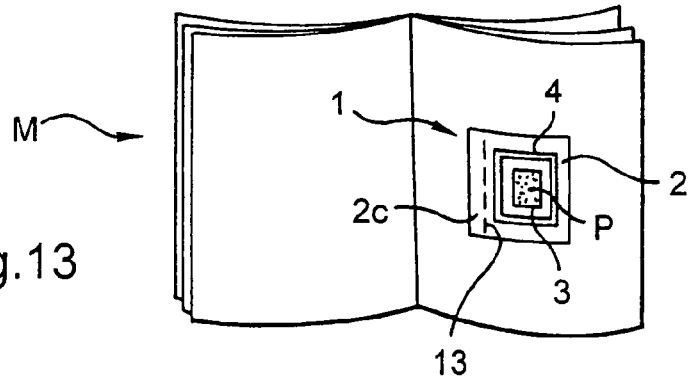
FIG. 13 shows a magazine with a page to which an exemplary device has been fastened.

The device 1 may be secured, for example, stuck, to a page of a magazine M, as shown in FIG. 13.

In other exemplary embodiments, the device 1 may form part of packaging, for example, a box. Such a box may serve to package another substance or a makeup accessory. In such embodiments, the support 2 may be constituted by a portion of said packaging, as shown in FIGS. 14 and 15.

Figure 14:
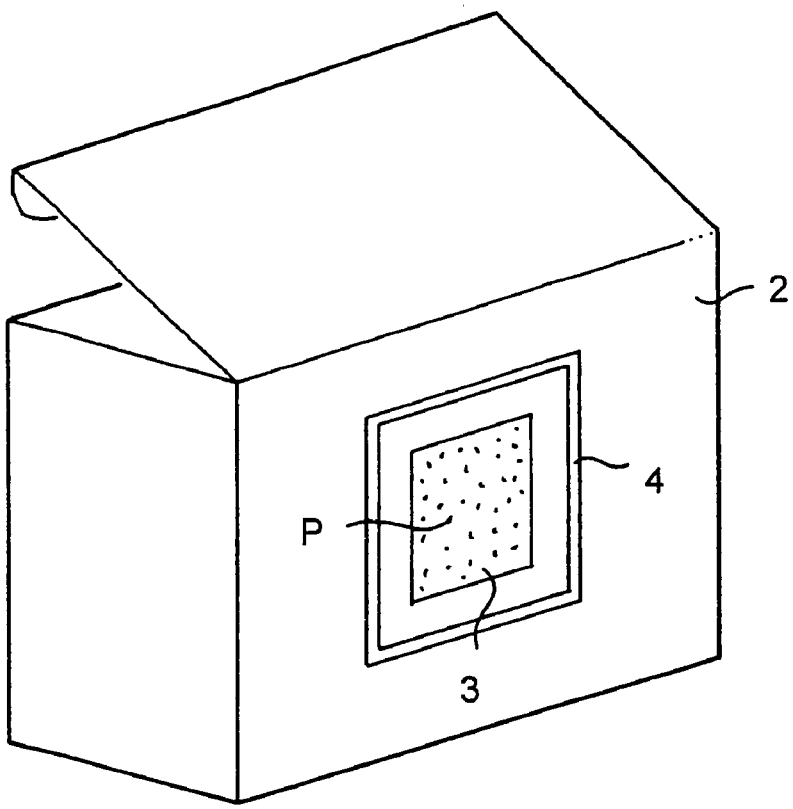
FIGS. 14 and 15 are diagrammatic views showing exemplary packaging.

As shown in FIG. 14, the cavity 3 may be formed in a side of a box. Where appropriate or desired, the cavity 3 may be surrounded by the protective bead 4. In FIG. 14, the film 8 is not shown.

The barrier-forming layer 25 may extend over a portion only of the side of the box carrying the cavity 3.

Figure 15:
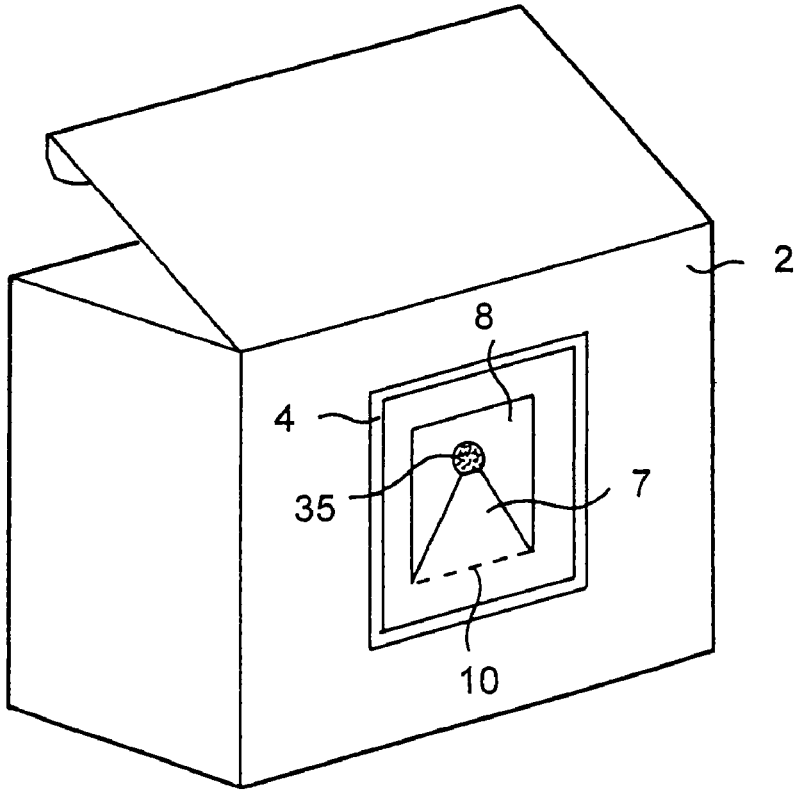

In FIG. 15, the box includes the window 8 in which the applicator 7 is cut out.

In other exemplary embodiments, the box may include both the cavity 3, filled with substance, and the applicator 7.

Throughout the description, including in the claims, the expression "comprising a" should be understood as being synonymous with "comprising at least one" unless specified to the contrary.

Although various details of the present invention has been described above with reference to particular embodiments, it is to be understood that the exemplary embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator device for applying at least one substance, comprising:

a support comprising:

a fibrous material;

a window;

at least one cavity configured to contain the substance; and an applicator comprising at least one cut out part of the support that is secured to said support at least before use, wherein at least a part of the applicator extends into the window of the support.

2. A device according to claim 1, wherein the support comprises cardboard.

3. A device according to claim 1, wherein the cavity comprises at least one of a mechanical deformation and a thermal deformation of the support.

4. A device according to claim 3, wherein the cavity comprises an embossing of the support.

5. A device according to claim 3, wherein the cavity includes a bottom wall of a thickness that is less than or equal to the thickness of at least a portion of the support situated around the cavity.

6. A device according to claim 3, wherein the cavity projects on a face of the support.

7. A device according to claim 6, wherein the cavity projects over a height that is not greater than a nominal thickness of the support.

8. A device according to claim 1, wherein the support includes at least one layer of a barrier-forming material.

9. A device according to claim 8, wherein the barrier-forming material is selected from: a polyolefin; a high-density polyethylene; a metal; a varnish; and a laminate made with such materials.

10. A device according to claim 9, wherein the barrier-forming material comprises at least one of a deposited coating and a rolled layer on a remainder of the support.

11. A device according to claim 1, further comprising a peel-off film closing the cavity at least before first use.

12. A device according to claim 1, wherein the applicator comprises an application surface that is defined, at least in part, by a material that is different from a material of the support.

13. A device according to claim 12, wherein the application surface comprises at least one of a flocking, a foam, and a felt.

14. A device according to claim 1, wherein the applicator is connected to the support via a frangible zone.

15. A device according to claim 1, including a hinge to enable the support to be folded in half.

16. A device according to claim 15, wherein the hinge is disposed substantially in the middle of the support, separating two portions including substantially equal dimensions.

17. A device according to claim 1, wherein the applicator includes a score line configured to enable the applicator to be folded in half.

18. A packaging device for packaging a substance comprising:

a support including a periphery and comprising:

a fibrous material;

at least one cavity configured to contain the substance and comprising a deformation of the support, said cavity opening to a first face of the support; and a bead that is distinct from the cavity, extending one of continuously and discontinuously around the cavity at a distance therefrom, and that is set back from the periphery of the support, said bead not containing a substance and comprising a deformation of the support, said bead projecting on a second face of the support, remote from the first face.

19. The device of claim 1, wherein the substance is a cosmetic.

20. The device of claim 1, wherein the applicator is not in contact with the substance prior to a first use.

21. The device of claim 1, wherein the cavity opens on one side of the support.

22. A method of manufacturing a packaging and applicator device for applying at least one substance, comprising a support comprising:

a fibrous material;

a window;

at least one cavity configured to contain the substance; and an applicator comprising at least one cut out part of the support that is secured to said support at least before use, wherein at least part of the applicator extends into the window of the support, the method comprising:

embossing the support so as to form the cavity; and cutting out part of the support so as to form the applicator.

23. A packaging and applicator device for applying at least one substance, comprising a support comprising:

a fibrous material;

at least one cavity configured to contain the substance;

an applicator comprising at least one cut out part of the support that is secured to said support at least before use;

at least one bead that is distinct from the cavity.

24. A device according to claim 23, wherein the bead comprises a deformation of the support.

25. A device according to claim 24, wherein the cavity opens into a first face of the support, and wherein the bead projects on a second face of the support, remote from the first face.

26. A device according to claim 23, wherein the bead extends around the cavity.

27. A device according to claim 23, wherein the bead includes a thickness that is not less than a depth of the cavity.

28. A device according to claim 23, wherein the bead extends around the applicator.

29. A device according to claim 28, wherein a thickness of the applicator at the application surface is not greater than a thickness of the bead.

30. A packaging and applicator device for applying at least one substance, comprising a support comprising:

a fibrous material;

at least one cavity configured to contain the substance;

an applicator comprising at least one cut out part of the support that is secured to said support at least before use; and a detachable flap configured to facilitate fastening of the device to an article.

31. A method of manufacturing a packaging and applicator device for applying at least one substance, comprising a support comprising:

a fibrous material;

at least one cavity configured to contain the substance; and an applicator comprising at least one cut out part of the support that is secured to said support at least before use, the method comprising:

embossing the support so as to form the cavity and a bead; and cutting out part of the support so as to form the applicator.

32. A device according to claim 9, wherein the metal is aluminum.

* * * * *